US008201282B2

(12) United States Patent
Wilson

(10) Patent No.: US 8,201,282 B2
(45) Date of Patent: Jun. 19, 2012

(54) HIGH EFFICIENCY URINAL SYSTEM

(75) Inventor: John R. Wilson, Naperville, IL (US)

(73) Assignee: Sloan Valve Company, Franklin Park, IA (US)

( * ) Notice: Subject to any disclaimer, the term of this patent is extended or adjusted under 35 U.S.C. 154(b) by 321 days.

(21) Appl. No.: 12/422,030

(22) Filed: Apr. 10, 2009

(65) Prior Publication Data

US 2010/0257665 A1 Oct. 14, 2010

(51) Int. Cl.
*E03D 13/00* (2006.01)

(52) U.S. Cl. ..... 4/310; 4/365; 4/420; 4/442; 4/302

(58) Field of Classification Search ..... 4/365, 310, 4/393, 363, 302, 303, 325, 367, 301, 392, 4/420, 442

See application file for complete search history.

(56) References Cited

U.S. PATENT DOCUMENTS

| | | | | |
|---|---|---|---|---|
| 329,806 | A | 11/1885 | Boyle | |
| 577,021 | A | 2/1897 | Groszmann | |
| 644,882 | A | 3/1900 | Wangelin | |
| 675,491 | A * | 6/1901 | Mann | 4/365 |
| 901,525 | A | 10/1908 | Depew | |
| 995,555 | A | 6/1911 | Parker | |
| 1,428,971 | A | 9/1922 | Neumeyer | |
| 1,613,640 | A | 1/1927 | Bartosik | |
| 1,670,975 | A * | 5/1928 | McCleery | 4/365 |
| 2,147,588 | A | 2/1939 | Zinkil et al. | |
| 2,199,068 | A * | 4/1940 | Egenas | 4/365 |
| 2,349,015 | A | 5/1944 | Stalcup | |
| 2,717,396 | A * | 9/1955 | Chiles | 4/367 |
| 3,112,497 | A * | 12/1963 | Call | 4/415 |
| 3,908,202 | A | 9/1975 | Sargent et al. | |
| 3,964,110 | A | 6/1976 | Kapit | |
| 4,107,796 | A | 8/1978 | Nafziger | |
| 4,407,026 | A * | 10/1983 | Myers | 4/365 |
| 5,027,448 | A | 7/1991 | Wilkins | |
| 5,390,374 | A | 2/1995 | Hubrig et al. | |
| 5,666,674 | A | 9/1997 | Hennessy | |
| 5,887,293 | A | 3/1999 | Hennessy | |
| 6,317,899 | B1 | 11/2001 | Brewer | |
| 6,611,967 | B1 | 9/2003 | Hennessy et al. | |
| 7,367,541 | B2 | 5/2008 | Muderlak et al. | |
| 2002/0069457 | A1 * | 6/2002 | Meier et al. | 4/226.1 |
| 2006/0015994 | A1 | 1/2006 | Simmons | |
| 2008/0256695 | A1 | 10/2008 | Allen | |

FOREIGN PATENT DOCUMENTS

| | | |
|---|---|---|
| KR | 2019900000062 | 1/1990 |
| KR | 2019960037607 | 12/1996 |
| KR | 1020000058718 | 10/2000 |
| KR | 2002546270000 | 12/2001 |

OTHER PUBLICATIONS

International Search Report and Written Opinion for PCT/US2010/030122, issued Nov. 4, 2010.

* cited by examiner

*Primary Examiner* — Jason J Boeckmann
*Assistant Examiner* — Joel Zhou
(74) *Attorney, Agent, or Firm* — Foley & Lardner LLP

(57) ABSTRACT

A flush mechanism for use in a urinal. The flush mechanism includes a flush reservoir pivotally mounted within a flush frame. The flush mechanism receives water from an inlet above the flush reservoir. The flush reservoir is pivotable from a fill position to a flush position whereby the water is dispensed to a manifold within the urinal for flushing of the urinal. The flow of water into the flush reservoir and the actuation of the flush reservoir may be directed by a controller.

21 Claims, 8 Drawing Sheets

HIGH EFFICIENCY URINAL SYSTEM

FIELD OF THE INVENTION

The present invention relates generally to the field of high efficiency urinals, more particularly to flush and control systems for low flush volume fixtures.

BACKGROUND OF THE INVENTION

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Recently increased focus has been placed on reducing the volume of water used for each flush through the use of low flush volume fixtures. The use of low flush volumes with current urinals results in a reduced cleansing effect of the flush. The lower flush volume provides less water to cleanse the urinal. Further, prior art urinals utilizing a reduced volume of water provide the water to the manifold at an insufficient volume per second to achieve the desired head pressure in the manifold. In addition, the prior art flush valves provide the flush volume to the manifold via a vacuum breaker, which typically has an outlet significantly narrower than that of the manifold, requiring the water to spread horizontally in the manifold to reach those holes at the outer edges. It should be appreciated without a sufficient volume of water in the manifold such prior art systems would fail to have water drain from the holes at the outer edges, thus resulting in a small portion of the sidewall cleansed via the flush.

High efficiency fixtures present the difficulty of utilizing a plumping infrastructure that was generally designed with a much higher flush volume in mind. Thus, the use of current flush and control mechanisms with low flush volume urinals presents several problems.

SUMMARY OF THE INVENTION

One embodiment of the invention relates to a urinal comprising a lower portion, a middle portion and an upper portion. The lower portion including a receptacle with a drain, the middle portion including a backstop and sidewalls for guiding liquid waste to the drain and connecting the lower portion to the upper portion, the upper portion containing a manifold and flush mechanism. The manifold is positioned above the receptacle and comprises a chamber having a floor that includes a plurality of holes positioned adjacent the backstop, allowing fluid from the manifold to flow from the manifold down the backstop into the receptacle. The flush mechanism is disposed above the manifold and includes a flush reservoir pivotally positioned within a flush reservoir frame. The flush mechanism is in fluid communication with a water inlet and a flush actuator. The flush reservoir includes a housing having an opening and being pivotable, in relation to the manifold, about a pivot axis, the housing being nonsymmetrical about the pivot axis. The flush reservoir has a fill position and a flush position; the flush reservoir configured to remain in a fill position when empty and move to the flush position when a threshold volume of water is in the reservoir. The flush reservoir opening is in fluid communication with the water inlet when in the fill position and in fluid communication with the manifold when in the flush position.

In an alternative embodiment, the present invention relates to a flush mechanism for a urinal comprising a flush reservoir pivotally positioned within a flush reservoir frame. The flush mechanism being configured to receive water from a water inlet positioned above the flush reservoir and dispense water to an area below the flush reservoir. The flush reservoir includes a housing defining a volume and including at least one opening. The flush reservoir has a fill position wherein the opening is at the top of the flush reservoir and pivotable above a pivot axis from the fill position to a flush position wherein the opening is at the lowest position of the reservoir in a side of the flush reservoir. The empty flush reservoir has a first center of gravity imposing a torque about the pivot axis such that flush reservoir is most stable in the fill position. The flush reservoir has a second center of gravity when the flush reservoir is filled to a threshold volume, such that the flush reservoir is more stable in the flush position. The flush mechanism further includes a flow control mechanism spanning the opening in the flush reservoir and spaced a distance from an edge of the flush reservoir over which fluid flows during a flush. The flow control mechanism and the flush reservoir housing define a flow aperture through which water is able to flow from the flush reservoir when in the flush position. The flush reservoir pivots from the fill position to the flush position when the flush reservoir is filled to the threshold volume and the water is dispensed from the flush reservoir until the center of gravity is again shifts to its original position, imposes a torque on the flush reservoir whereby the flush reservoir pivots back to the fill position.

These and other advantages and features of the invention, together with the organization and manner of operation thereof, will become apparent from the following detailed description when taken in conjunction with the accompanying drawings, wherein like elements have like numerals throughout the several drawings described below.

DETAILED DESCRIPTION OF THE PREFERRED EMBODIMENTS

Figure 1:
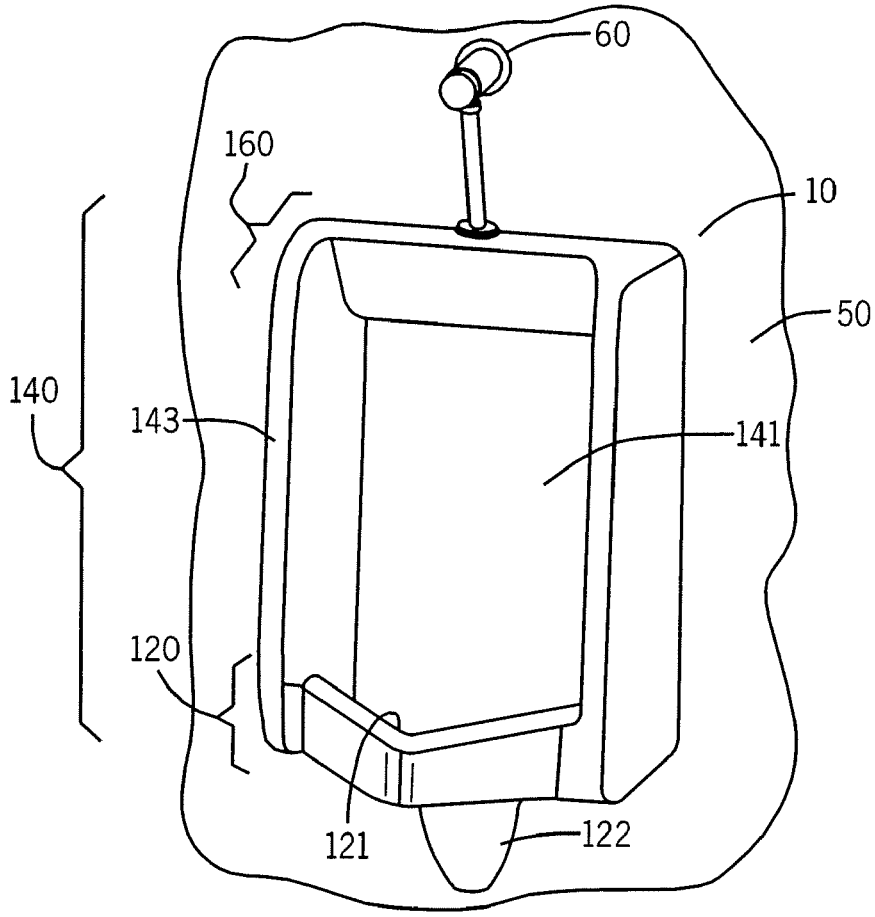
Prior Art FIG. 1
FIG. 1 illustrates a prior art urinal in cross-section.

Referring to FIG. 1, generally prior art urinals 10, generally attached to a wall 50, typically include a lower portion 120, a backstop 141, and an upper portion 160. It will be appreciated that the lower portion 120 contains a drain 122 for evacuating waste, the backstop 141 serves to retain the waste within the urinal 10 during usage, and the upper portion 160 includes a manifold [not shown], which receives water from a water source 60, which provides water to of the backstop 141 to cleanse the backstop 141 and assist in evacuating the waste to the drain 122. The effectiveness of the "flush" of the urinal 10 is depending on a number of factors, including, generally attached to a wall 50, the size of the backstop 141, the "use", the volume of water, the force of the water, and the size and location of the portion of the backstop 141. It should be appreciated that the size and location of the portion of the backstop 141 that is cleaned via the flush depends itself on a number of factors as know in the art, such as the size of drainage holes [not shown] in the manifold [not shown], the total volume of water in the flush cycle, the volume per unit of time during the flush cycle, particular at the beginning of the cycle, and the head pressure exerted by the volume of water in the manifold.

Referring to FIGS. 2A-D, one embodiment of a urinal fixture 101 of the present invention includes a lower portion 120 having a receptacle 121 with a drain 122, a middle portion 140 including a backstop 141 for guiding liquid waste [not shown] to the drain 122. The middle portion 140 connects the lower portion 120 to an upper portion 160 containing a manifold 161 and flush mechanism 180. The middle portion 140 may include sidewalls or splashguards 143 extending from the middle portion 140, preferably the length between the lower portion 120 and the upper portion 160. In one embodiment the urinal fixture 101 is designed to be wall mounted, such that the lower portion 120 extends from a wall 50, either along a floor [not shown] or elevated above it, farther than the sidewalls 143, such that the water can flow from the manifold 161 along the backstop 141 down to the drain 122. In a further embodiment, the urinal fixture 101 may be recessed within the wall 50. In one embodiment, the urinal fixture 101 comprises a singular molded component for the upper portion 160, middle portion 140, and lower portion 120.

In one embodiment, the middle portion 140 may comprise a backstop 141 parallel with the wall 50, the backstop 141 providing receptacle 121 for receiving waste and guiding it to the drain 122, typically by allow the waste to sheet down the backstop 141 as is well known in the art. The middle portion 140 may further include sidewalls 143 that extend from the backstop 141 generally perpendicular to the wall 50. The sidewall 143 serves to retain waste that deflects from the backstop 141. It will be appreciated that the backstop 141 is preferred to have a wide width, comprising nearly the entire width of the urinal fixture 101.

The manifold 161 comprises an interior manifold chamber 162 in the upper portion 160, such as a molded interior manifold chamber 162 in the upper portion 160. The manifold 161 is configured to receive water from a manifold inlet aperture 163 and to transfer water to the middle portion 140, such as the backstop 141, to cleanse and transport waste. In one embodiment of the invention, the manifold inlet aperture 163 extends substantially the width of the manifold 161. It will be appreciated that the size of manifold inlet aperture 163 will restrict the total amount of water that can be transferred to the manifold 163 at a given flow rate. Prior art manifold design was not concerned with the size of the inlet aperture 163, other than being larger than the outlet [not shown] from the flush valve [not shown], because of the relatively small size of the outlet from the flush valve as compared to the size of the manifold 160.

The interior manifold chamber 162 includes a floor 165, preferably connected at one end to the backstop 141 and extending outward from the backstop 141, over the receptacle 121. Preferably, the interior manifold 162 has a width approximately the same as distance between the splash guards 143. The interior manifold chamber 162 includes a plurality of holes 166 in the floor positioned adjacent the backstop 141, allowing fluid from the manifold 161 to flow from the manifold 161 down the backstop 141 into the receptacle 121. Preferably, the holes 166 are spaced substantially the entire width of the backstop 141. The size, spacing, and number of holes 166 impact the effectiveness of a flush at cleaning the backstop 141. In one embodiment, eighteen equidistant $3/16^{th}$ inch holes are provided. Other apparatus, such as rectangular slots, may be used to distribute the water in the manifold chamber 162 to the backstop 141. It will be appreciated that the number, size, and spacing of the holes 166 maybe selected to optimize the cleansing of the urinal fixture 101. Typically in the prior art, the holes 166 needed to be sized to accommodate the time between the initial water entering the manifold 161 and sufficient head pressure developing within the manifold 161. However, the present invention reduces this time by more quickly filling the manifold 161

The flush reservoir 181 is disposed above the manifold 161. The flush reservoir 181 provides water to the manifold 161 to allow cleansing of the backstop 141 and receptacle 121 and evacuation of waste from the urinal fixture 101. The flush reservoir 181 is connected to at least one water source 60 via an inlet 256. Specific embodiments regarding the water source 60 are discussed further below in regard to FIG. 7.

As illustrated in FIGS. 3-6B, the flush reservoir 181 includes a flush reservoir 181 pivotally positioned within a flush reservoir frame 182. The flush reservoir frame 182 may be an integral portion of the upper portion 160 of the urinal fixture 101 or may be a separate component fixable to the urinal fixture 101. The flush reservoir frame 182, or another component [not shown] may serve to restrict the degree to which the flush reservoir 181 is able to pivot. It will be appreciated that the restriction of the range of motion of the flush reservoir 181 is desirable in certain embodiments to provide for a controlled discharge of the water into the manifold 161. Thus, limiting the amount of movement possible for the flush reservoir 181 allows for control of the kinetic energy imparted to the water contained in the flush reservoir 181. In one embodiment, the flush reservoir 181 is configured to pivot about 45 degrees from the fill position 193 to the flush position 195.

The flush reservoir 181 has a three-dimensional hollow shape having an open top face 185 for receiving water from the inlet 256. The shape of the flush reservoir 181 is such that it provides for a shifting of the center of gravity as the flush reservoir fills (and as it empties). Thus, various nonsymmetrical (about a longitudinal axis) shapes that would result in the creation of a moment are utilized in various embodiments.

Figure 4A:
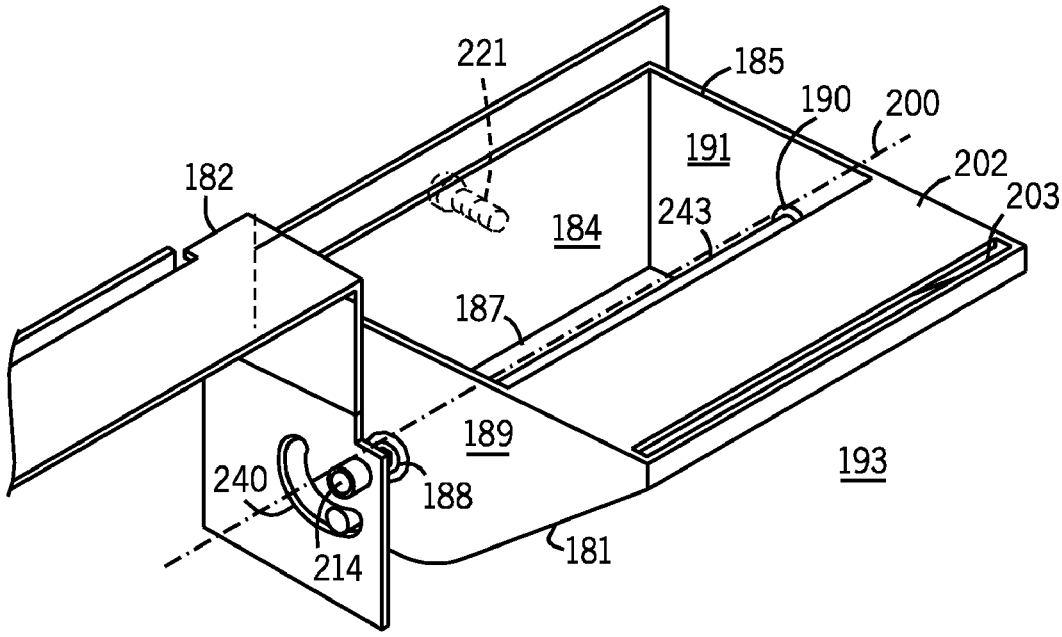
FIG. 4A illustrates a perspective view of a flush mechanism in accordance with the principles of the present invention having a flow guide and in the fill position.
Figure 4B:
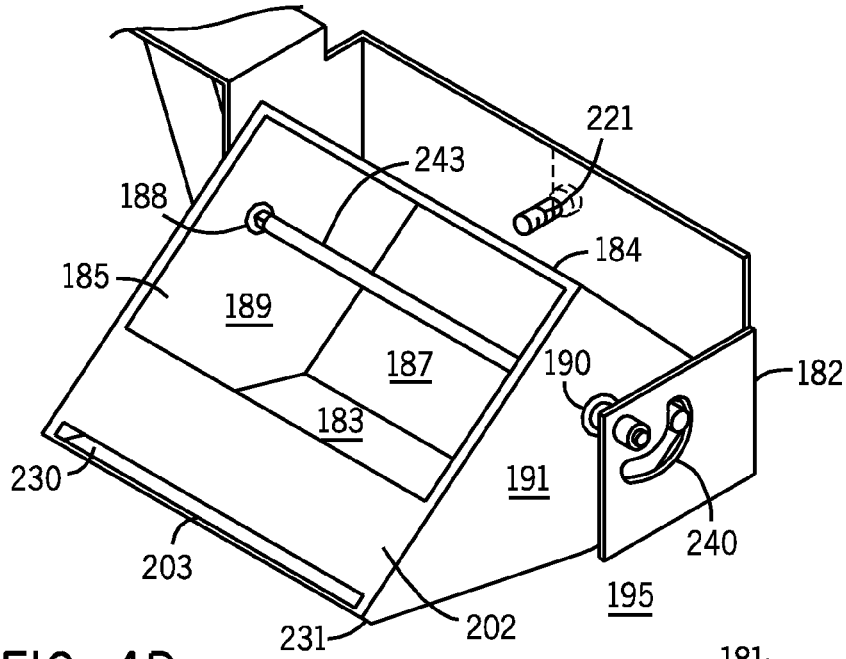
FIG. 4B illustrates a cut-away view of the flush reservoir of FIG. 4A in the flush position.
Figure 4D:
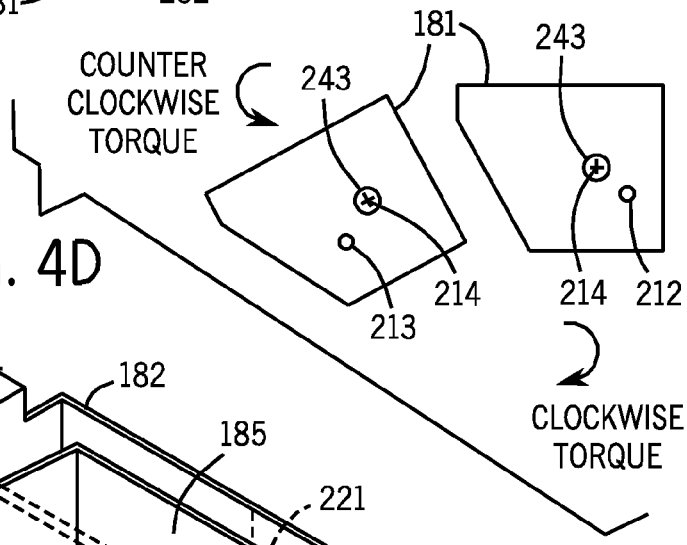
FIG. 4D illustrates the shifting center of gravity at the flush and fill positions.
Figure 4C:
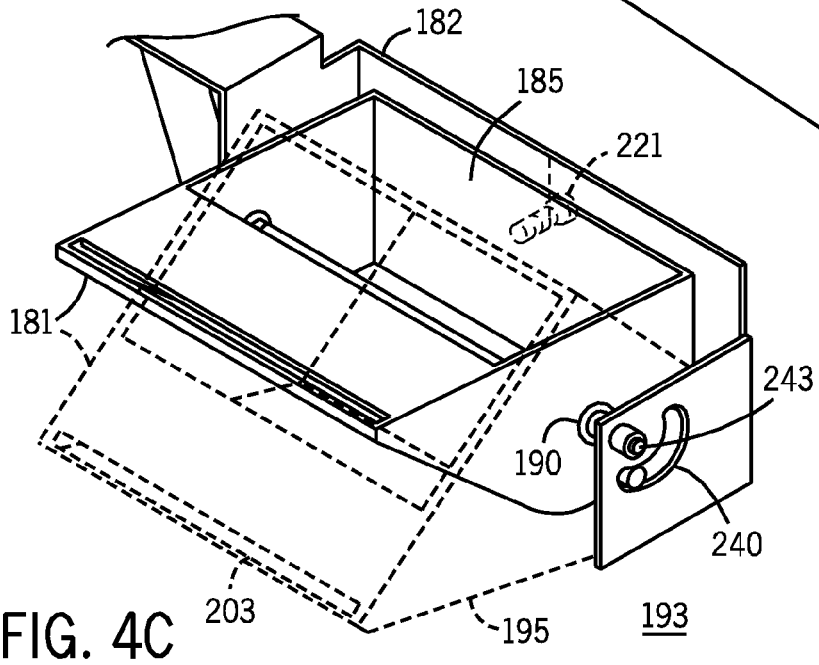
FIG. 4C illustrates a cut-away view of the flush reservoir of FIG. 4A in the fill position with the flush position in phantom.
Figure 5A:
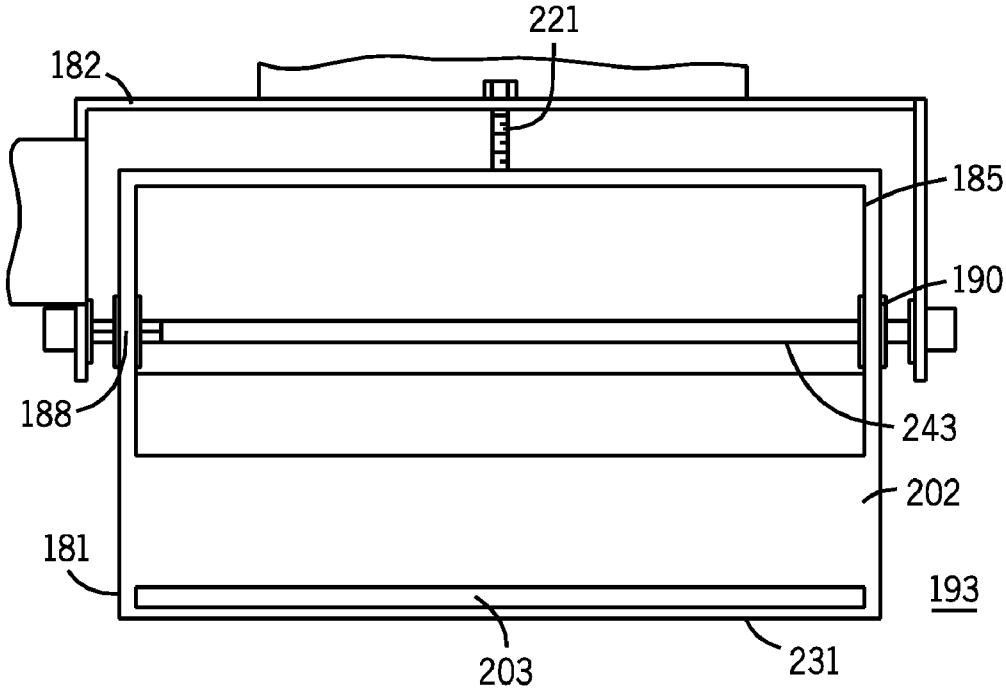
FIG. 5A illustrates a top view of a flush mechanism in accordance with the principles of the present invention in the fill position.
Figure 5B:
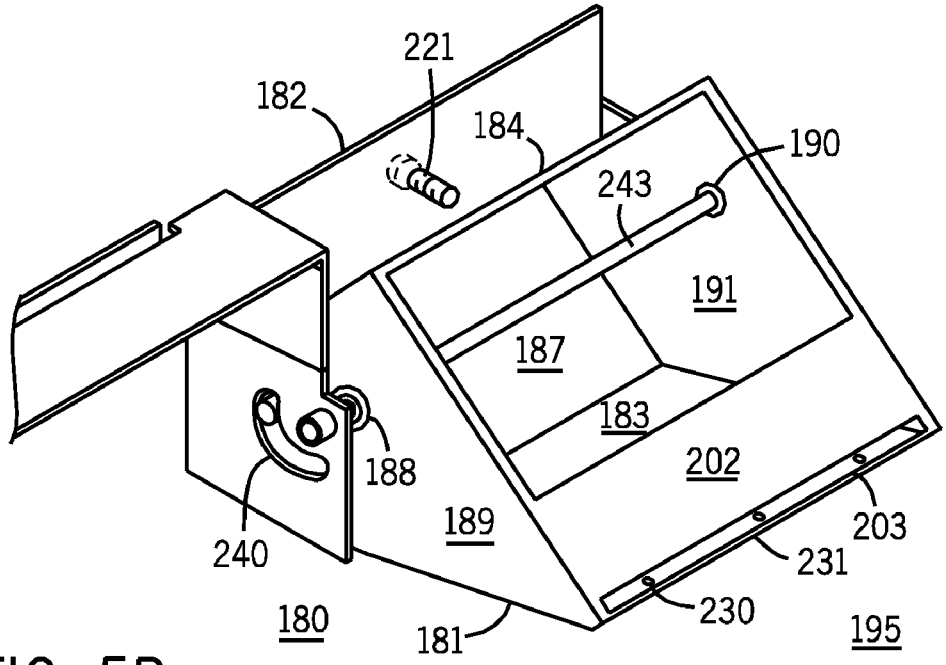
FIG. 5B illustrates a front view of the flush reservoir of FIG. 5A in the flush position.

Preferably, the flush reservoir 181 is a polyhedron having a front side 183, a back side 184, a bottom 187, a first parallel side 189 and a second parallel side 191. In one embodiment, the back side 184 is perpendicular to the bottom 187 and the front side 183 is positioned non-parallel to both the back side 184 and the bottom 187. In one embodiment, the reservoir 181 has a generally trapezoidal cross-section, with the wider parallel edge of the trapezoid being on top, i.e. distal to the middle portion 140 and forming the top face 185 of the flush reservoir 181. The flush reservoir 181 is rotatably or pivotally connected to the flush reservoir frame 182 at a first pivot point 188 on the first parallel side 189 of the flush reservoir 181 and a second pivot point 190 on the second parallel side 191 of the flush reservoir 181. In one embodiment, an axle 243 extends through the pivot points 188, 190 and engages with the flush reservoir frame 182 to support the flush reservoir 181 in a pivotable relationship to the flush reservoir frame 182. The flush reservoir 181 is configured to pivot from a fill position 193 as seen in FIGS. 4A and SA to a flush position 195 as seen in FIGS. 5B and 4B. FIG. 4C illustrates both positions, with the fill position 193 in solid lines and the flush position 195 in phantom. The pivoting of the flush reservoir 181 pivots the open top face 185 with regard to the manifold 161.

Figure 3:
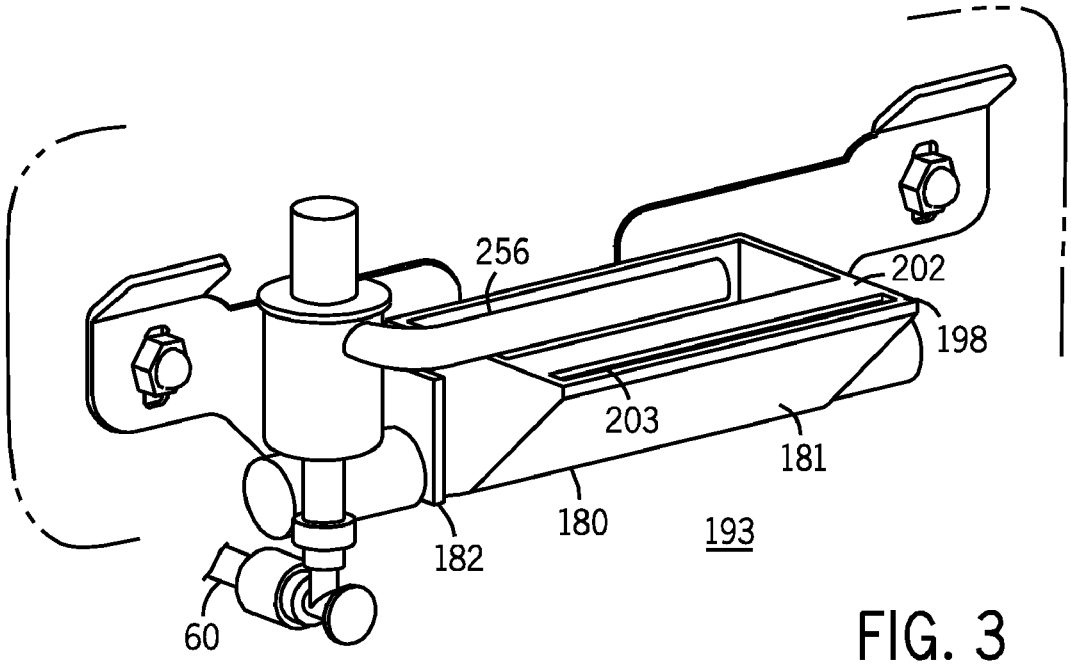
FIG. 3 illustrates a perspective view of a flush mechanism in accordance with the principles of the present invention.

In one embodiment shown in FIG. 3, in the fill position 193, the open top face 185 of the flush reservoir 181 is generally parallel to the floor or bottom side 187. When in the fill position 193, the inlet 256, which is in communication with the water source 60 and that may comprise multiple inlets as further described below, is in fluid communication with the flush reservoir 181 such that the flush reservoir 181 may be filled with water from the inlet 256. When the flush reservoir 181 is pivoted within the flush reservoir frame 182, the open top face 185 rotates towards the floor. As the flush reservoir 181 pivots, the water contained within the reservoir will flow out of the open top face 185 over a flow edge 198, into the manifold 161. In one embodiment, the flow edge 198 is generally parallel to the wall 50 and a longitudinal axis 200 of the manifold 161. In one embodiment of the invention, the manifold inlet aperture 163 extends substantially the width of the manifold 161, as discussed further below, to accommodate water dispensed from the flush reservoir 181 along the flow edge 198 that is substantially as wide as the interior manifold chamber 162.

In one embodiment illustrated in FIGS. 4A-5B, a flow guide 202 transverses the open top face 185 of the flush reservoir 181. The flow guide 202 is positioned proximate to the flow edge 198 and preferably is substantially parallel with the flow edge 198. As best shown in FIGS. 5A and 5B, the flow guide 202 and the flow edge 198 define a flow aperture 203 through which the water exits the flush reservoir 181 during a flush event. The flow guide 202 has a width associated therewith. The width of the flow guide 202 is preferably sufficient to prevent the water from flowing over the flow guide 202 during a flush event in addition to through the flow aperture 203. It should be appreciated that the flow guide 202 effectively restricts the size of the area of the open top face 185 in regard to filling from the inlet 256 as well. Thus, it is preferable to select a width necessary to prevent water from flowing over the flow guide 202 when the flush reservoir 181 pivots during a flush, while allowing for the desired flush profile. In an alternative embodiment, the flow guide 202 extends over the entirety of the open top face 185 except for the flow aperture 203 and includes an inlet 256 opening through which water flows to fill the flush reservoir 181. It should be appreciated that the flow guide 202 and/or the flow edge 198 may be shaped to provide a desired water flow profile. The flow aperture 203 may be varied along axis 200 to promote more water delivered to zones near first parallel wall 189 and second parallel wall 191 to distribute evenly water in manifold chamber 162. One non-limiting example would be to provide the flow edge with a "bow-tie" shape to provide a larger volume of water at the outer edges of the manifold chamber 162 enabling the use of additional holes in the manifold chamber 162 to rinse the side of the urinal 10.

Figure 6A:
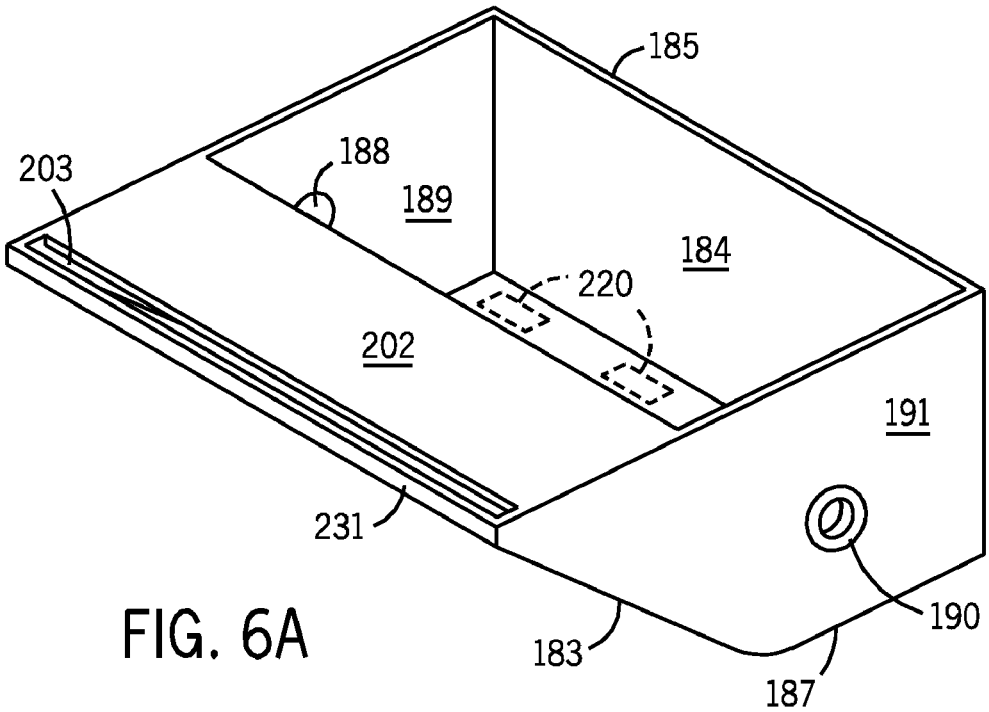
FIG. 6A illustrates a perspective view of the flow edge of the flush reservoir of FIG. 4A.
Figure 6B:
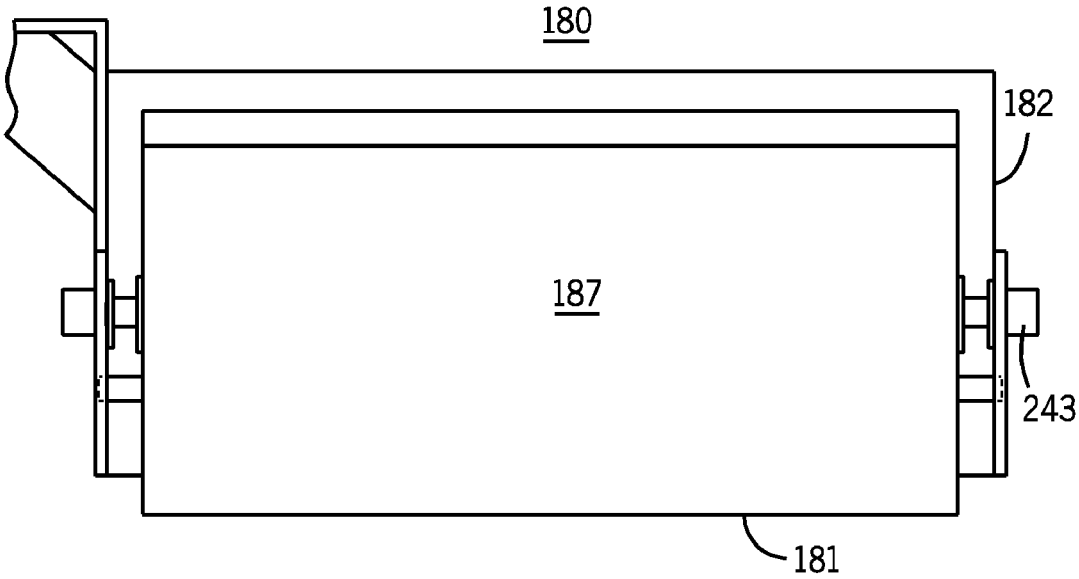
FIG. 6B illustrates a front view of the flow edge of the flush reservoir of FIG. 4A.
Figure 8B:
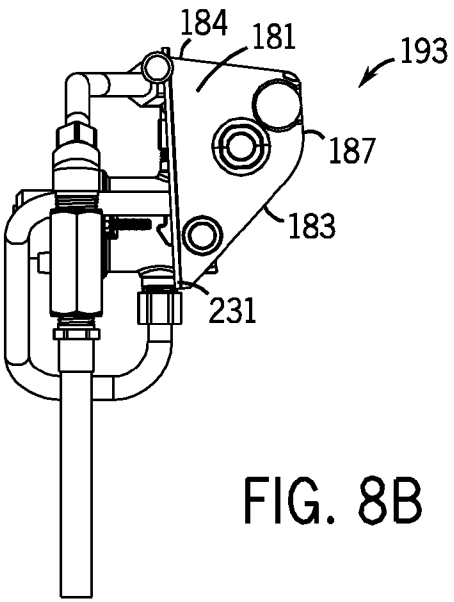
FIG. 8B illustrates a side view of the device of FIG. 8A.
Figure 8A:
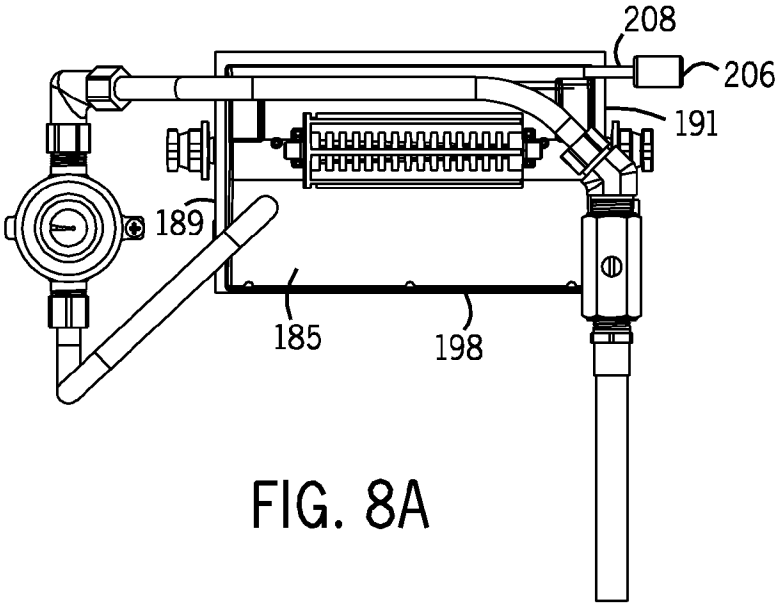
FIG. 8A illustrates a top view of an automated mechanism, in a locked position, for controlling the flush reservoir's movement.
Figure 8C:
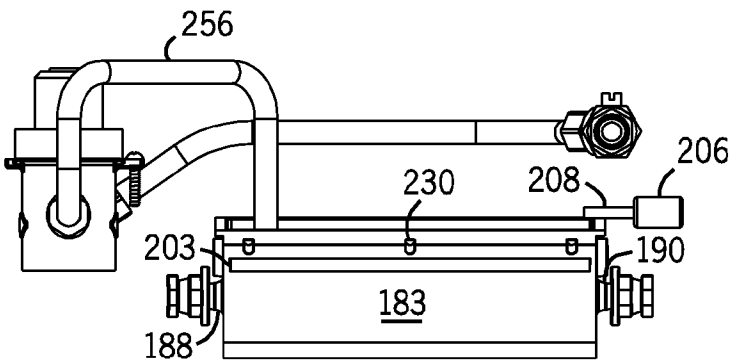
FIG. 8C illustrates a front view of the device of FIG. 8A.
Figure 9B:
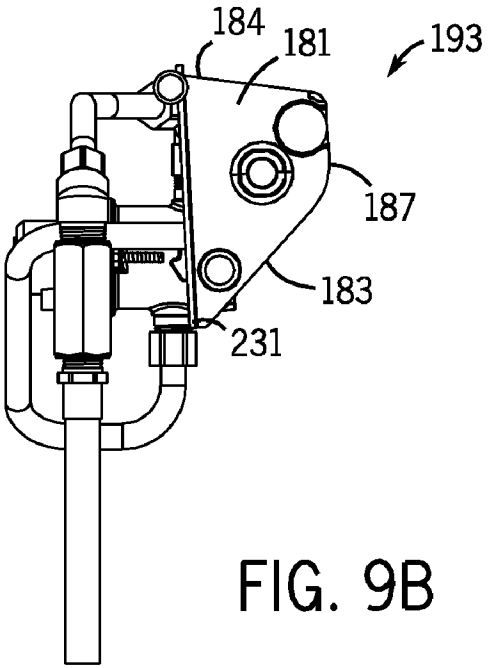
FIG. 9B illustrates a side view of the device of FIG. 9A.
Figure 9A:
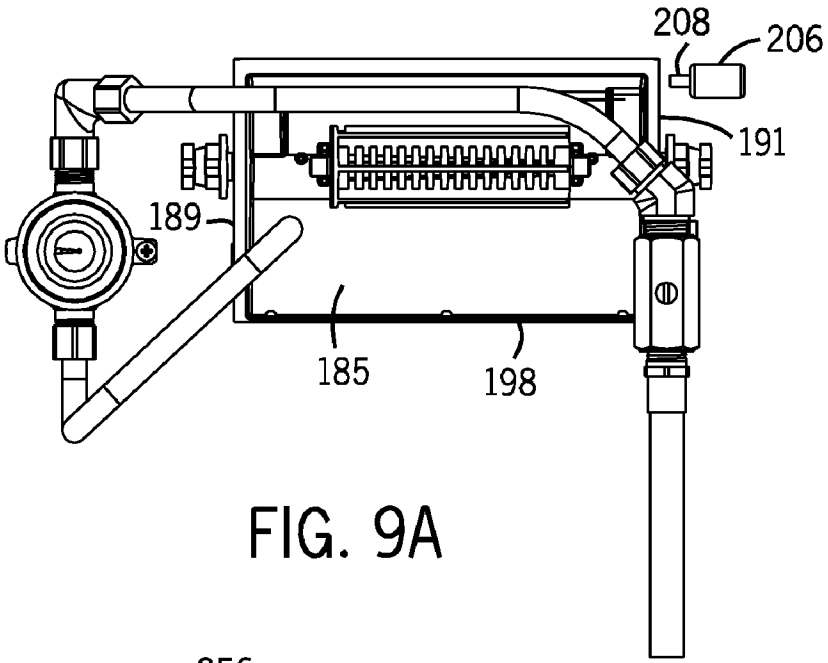
FIG. 9A illustrates a top view of the automated mechanism of FIG. 8A, but in an unlocked position.
Figure 9C:
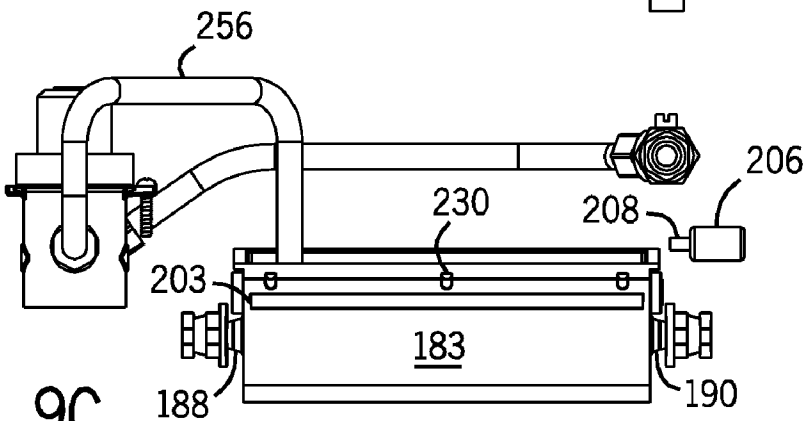
FIG. 9C illustrates a front view of the device of FIG. 9A.

In one embodiment best shown in FIGS. 6A and 6B, the first end includes a lip 231. The lip 231 comprises a truncation of front side 183 (the longer non parallel side of the flush reservoir). Thus, rather than the front side 183 extending in a single path to the open top face 185, the flow edge 198 is formed by truncating the front side 181 proximate the open top face 185 and providing the lip 231 as an upright portion extending up from the front side 183 so as to be, in one embodiment, substantially parallel to the back side 184. The lip 231 may constitute an edge to retain the water in the event of a non-ideal (i.e., not level) installation. The lip can compensate for a non-ideal installation by allowing the reservoir 181 to fill with more water increasing the torque biasing the reservoir 181 to the flush position 195.

The pivoting of the flush reservoir 181 may be accomplished in a variety of ways. In one embodiment, the flush reservoir 181 is in communication with an actuator 206 that shifts the flush reservoir 181 to the flush position 195 when a flush is initiated and/or returns to the fill position upon 193 completion of a flush. In an exemplary embodiment shown in FIGS. 8A-C and 9A-C, the flush reservoir 181 is biased to remain in the fill position 193 by a fill biasing mechanism, such as a retention pin 208, controlled by the actuator 206 that allows for pivoting the flush reservoir 181 to the flush position 195. Thus, the retention pin 208 prevents pivoting of the flush reservoir 181 even when it is filled, allowing for separate control of filling and flushing.

In one embodiment, the flush reservoir 181 has a bi-stable state, wherein the flush reservoir 181 is stable in a first position (the fill position 193) and a second position (the flush position 195). The pivoting of the flush reservoir 181 may be controlled utilizing a changing center of gravity in the flush reservoir 181 itself. Referring to FIGS. 4C and 4D, when empty, the flush reservoir 181 has a first location 212 of the center of mass that imposes a clockwise torque, generally around by the axle 243 upon which the flush reservoir pivots. Thus, the flush reservoir 181 will tend to remain in the fill position 193. As the flush reservoir 181 fills, the center of gravity changes. Preferably, the flush reservoir 181 is sized and shaped so that the desired threshold volume of water for a flush is equal to the volume of water necessary to shift the center of gravity to generate a counterclockwise torque about the pivot axis 214, illustrated as a second location 213 in FIG. 4D, though it should be appreciated that the flush reservoir 181 will not be stable once the center of mass is vertical below above the pivot axis 214 and will tend to pivot to reach a stable position. Thus, when the flush reservoir 181 is filled to (or above) this volume, the flush reservoir 181 will pivot to place its center of mass below the pivot axis 214. In doing so, the open top face 185 rotates toward the manifold 161 and the water in the flush reservoir 181 is able to flow out of the flow aperture 203. As the water drains from the flush reservoir 181—into the manifold 161—the center of mass of the flush reservoir 181 changes. In one embodiment having a trapezoidal cross-section, as the flush reservoir 181 begins to tilt, the water shifts further moving the center of gravity, encouraging more water to shift until the flush reservoir 181 pivots to the flush position 195. When the flush reservoir 181 is substantially empty, the center of mass transitions back to the original position 212, imposing a clockwise torque and the flush reservoir 181 rotates back to the fill position 193.

In an alternative embodiment, weights 220 may be added to the flush reservoir 181 to further alter the center of gravity to achieve a desired profile for the amount of water necessary to trigger a shift to the flush position 195. It should be further appreciated that the flush reservoir 181 may be provided with an adjustable weight system [not shown] to allow a user to make fine adjustments to the balance of the flush reservoir 181.

The flush reservoir 181 is able to be filled at any nearly desired speed. Thus, greater control can be provided regarding water usage utilizing the described urinal 101. In essence, the flush reservoir 181 acts like a capacitor, it can take in a small amount of water over time up to a threshold amount then release it all at once. In one embodiment, the flush reservoir 181 may fill and be held in the flush position (such as by the actuator 206) until a flush cycle is activated. Alternatively, the flush reservoir 181 may fill quickly to minimize "down time" between flushes. The reservoir 181 may also be partial filled while the patron is present, and the final filling completed after the patron departs to prevent flushing while the patron is immediately near the urinal.

The flush reservoir 181 allows a low gallon-per-minute fill rate to be used to provide the water to the urinal 101, while providing a high gallon-per-minute flow rate during an actual flush cycle. For example, the flow reservoir may be slowly filled at a rate of 0.1 gallons per minute. A 0.1 gallon flow reservoir takes 1 minute to fill. However, the flush cycle of may result in the entire 0.1 gallons being dispensed to the backstop 141 in one second, achieving a 6 gallon-per-minute flow rate. As should be appreciated the flush reservoir 181 can provide a "flow-rate multiplier" to the inlet 256. Slow fill rates are desirable for a number of reasons, including allow a smaller diameter of feed pipes in the plumping system and an overall lower maximum system capacity for the plumping system. In one embodiment, the fill rate is about that of a standard faucet, 1 GPM.

The increased speed with which the manifold 161 is filled also provides additional benefits. In prior art systems, the outlet from the flush valve, providing water to the manifold, is typically much smaller in area than the manifold 161. Thus, water fills from the middle of the manifold 161 outward. Thus, the initial water flow from the manifold 161 down the backstop 141 will only be draining from the manifold 161 holes in the center. Further, the water will not drain with sufficient force for effective cleaning until a sufficient head pressure is built. In one embodiment, the current system fills the entire width of the manifold 161 simultaneously upon actuating a flush cycle. In addition, the width of the flush reservoir 181 is such that the water is deposited substantially over the entire width of the manifold 161 with little to no need for the water to disperse across the floor 165. This allows the manifold 161 to be completely filled across its entire width (i.e., across all of the holes) and an adequate head pressure reached prior to substantial amounts of water draining through the holes 166. Thus, for nearly the entirely of the flush cycle, water drains from all of the holes 166 with an appropriate force.

Figure 7:
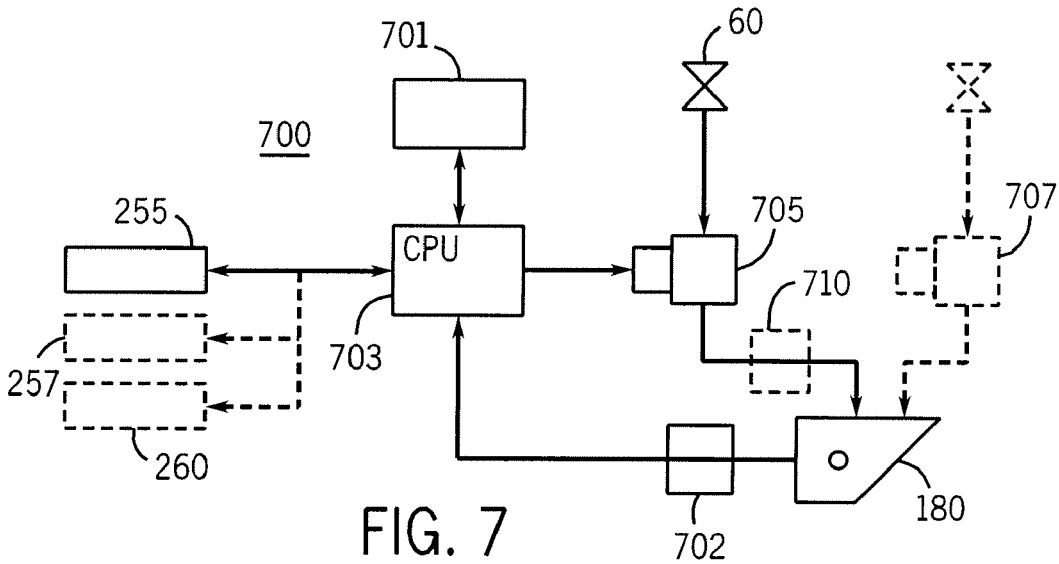
FIG. 7 is a diagram illustrating a flush system of the present invention.

In one embodiment, the flush reservoir 181 receives water via the inlet 256 from one of potable water, grey water, and a mixture thereof. One embodiment of a flush system of the present invention is illustrated in FIG. 7, discussed further below. The flush reservoir 181 includes two water sources 60, a potable water source 705 and a grey water source 707. In addition, a solid or liquid consumable dispenser 710 is positioned between at least one water source 60 and the flush reservoir 181 (illustrated as being on the potable water system, but it should be appreciated the consumable may be positioned on either or both water sources).

With continued reference to FIG. 7, in one embodiment, a control system 700 is provided for regulating the fill rate of the urinal fixture 101. The control system 700 may include a controller 703 that is able to control selectively the usage of potable water, grey water, or a mixture thereof to fill the flush reservoir 181. The controller 703 can be, in certain embodiments, configured to control the level of water in the flush reservoir 181, the speed with which the reservoir 181 is filled, and the use of cleaning supplies. In one embodiment, the controller 703 can trigger a flush cycle, for example, for cleaning purposes or for routine wetting of the drain 122.

In one embodiment, a plurality of drainage holes 230 are provided near the flow edge 198 to ensure compete drainage of the flush reservoir 181.

Figure 2D:
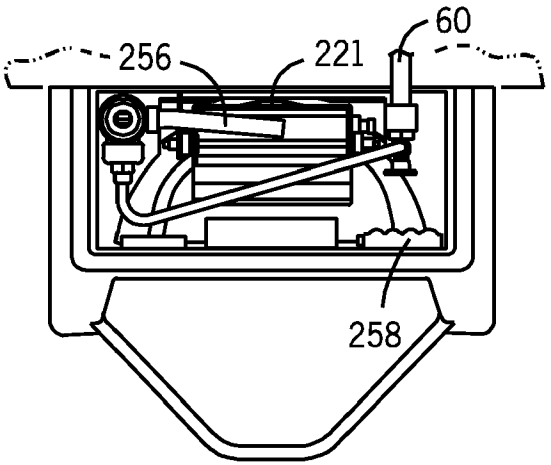
FIG. 2D illustrates a perspective partial cross-sectional view along line B-B of the urinal of FIG. 2A.
Figure 2C:
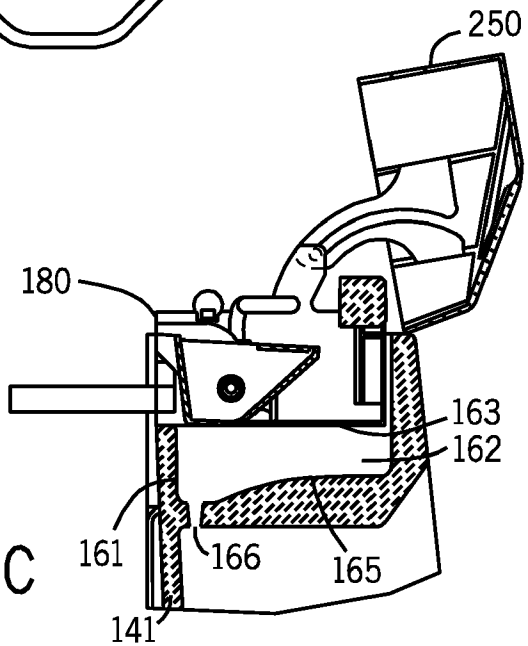
FIG. 2C illustrates the urinal of FIG. 2A in cross section along line A-A.
Figure 2B:
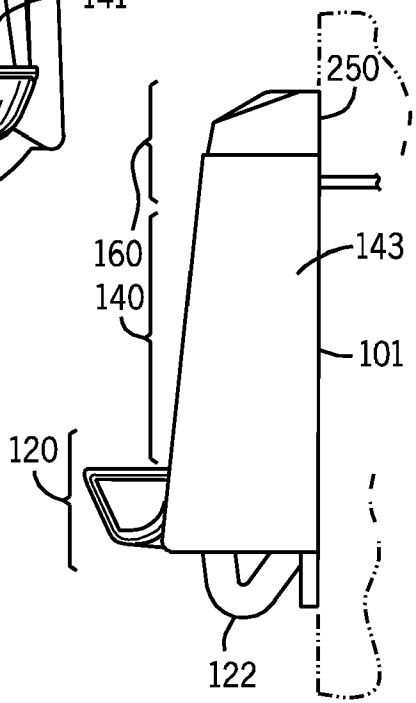
FIG. 2B illustrates a side-view of the urinal of FIG. 2A.

In one embodiment illustrated in FIGS. 2B-2D, the upper portion 160 includes an access panel 250 for allowing access to the flush reservoir 181. In one embodiment, the access panel provides access to the manifold 161 as well. It should be appreciated that access to consumables may also be provided. The access panel 250 may be provided as a hinged lid and preferable has a locking mechanism [not shown] to prevent unwanted access. In one embodiment, solar panels 260, discussed further below, are integrated with the access panel 250.

In one embodiment, the urinal fixture 101 includes a continuous run mode, for example for use in heavy user traffic situation such as sporting venues. In continuous run mode, the water inlet 256 continues to provide water to the flush reservoir 181 during a flush cycle. In one embodiment, the water will replenish the flush reservoir 181. If the rate of flow of water from the inlet 256 to the flush reservoir 181 is greater than the rate of water exiting the flush reservoir 181, then the flush reservoir 181 will remain in the flush position 195. If the flow rate from the inlet 256 is less than the flow rate from the flush reservoir 181, the flush reservoir will cycle between the fill state 193 and the flush state 195.

In one embodiment, the presence of a wide manifold inlet aperture 163 opening into the manifold 161 allows the interior manifold chamber 162 to be glazed. It should be appreciated by one of ordinary skill that glazing provides added benefits regarding the speed of which the water poured into the manifold 161 will disperse along the floor 165 of the manifold 161. Further, it should be appreciated that prior art urinals 10 utilize manifolds having a small inlet apertures to receive the lower end of the outlet from the flush valve. These prior art manifolds do not include an opening sufficient to allow glazing.

In a further embodiment, the manifold 161 includes a sloped floor 165. The floor 165 may be slightly sloped downwards angling towards the backstop 141, i.e. a lowest edge of the floor 165 will be that adjacent the wall 50 to which the urinal 101 is mounted while a highest edge will be the farthest from the wall 50. The use of a sloped floor 165 provides several advantages. First, the sloping of the floor 165 allows head pressure to be built up quicker due to the lower volume needed to establish a given depth of water as compared to a manifold 161 with a flat floor. Second, the complete drainage of the manifold 161 is encouraged though the action of gravity on the water. This feature also helps to counteract poor installations or aging installations where the urinal 101 is not level. Should the urinal 101 fall away from the wall 50 such that the low point in the manifold 161 would be that farthest from the wall 50, resulting in water that does not drain from the manifold 161.

In one embodiment, illustrated in FIG. 7, the urinal 101 is provided with at least one consumable dispenser 710. Consumables include, for example, cleaner, deodorizer, disinfectant, and colorant. Such consumables may be liquid or solid. The consumables may be dispensed into the flush reservoir 181, and thus allowed a period during a fill cycle to disperse. This provides the benefit of a more even application of the consumable in the manifold 161, and thus, to the entire back stop 141 up a flush event.

In one embodiment, the flush reservoir 181 includes a fill sensor 702 for indicating the position of the flush reservoir 181. In an exemplary embodiment, a magnetic sensor is provided on the flush reservoir 181 frame for detecting a corresponding component on the flush reservoir 181, such as a magnet. As illustrated in FIG. 7, the flush reservoir may be utilized as part of a control system 700. A fill sensor 702 may provide feedback to the controller 703 indicating the flush reservoir 181 should be filled. Such fill sensor 702 may be a sensor for detecting the position of the flush reservoir 181 or may be a separate sensor 701 for indicating a flush is needed, such as a traditional presence sensor. The controller 703 is in communication with at least one water supply system, such as potable water supply system 705 and alternatively also a grey water system 707. Further, the controller 703 may also be in communication with a consumable dispenser in operable communication with the flush reservoir 181 as discussed above. The flush reservoir 181 may then provide feedback to the controller 703, such as from the fill sensor 702. The control system further includes, in certain embodiments, a power source such as a battery 255 and or a solar panel 260, or a "hardwire" power source 257.

Returning to FIGS. 4A-4C, certain embodiments of the invention include a stop 221 for controlling the motion of the flush reservoir 181. The stop 221 may provide a limitation to the pivoting motion of the flush reservoir 181 such as to prevent the flush reservoir from pivoting "backwards", particularly due to momentum when the flush reservoir 181 rotates back to the fill position 193 from the flush position 195. In an alterative embodiment, a guide mechanism 240 may be provided to limit the range of motion of the flush reservoir 181. For example, FIGS. 4A-C and 5A-B illustrate a guide mechanism 240 include a protrusion extending into an accurate slot.

Figure 2A:
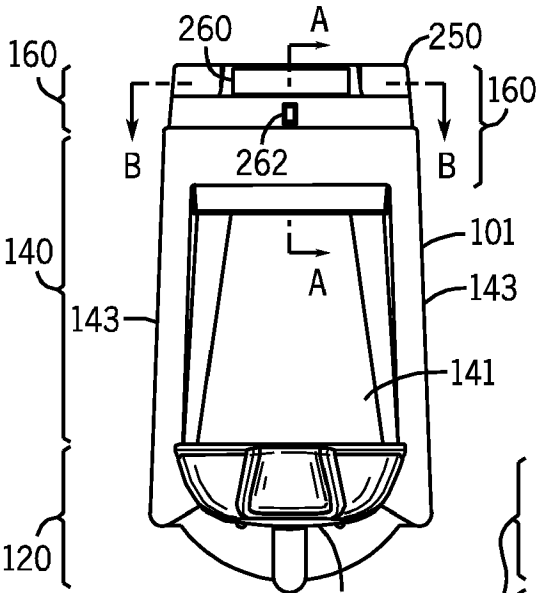
FIG. 2A illustrates a urinal in accordance with the principles of the present invention.

FIG. 2A also illustrates an embodiment whereby a presence sensor 262 is utilized. Such sensors are known in the art and it should be appreciated that such a sensor 262 could be utilized to provide information regarding the presence or absence of a user, such as to the controller 703.

The urinal fixture 101 may include electronic components as previously described. The urinal fixture 101 may utilize various sources of power such as a battery 255. In one embodiment, show in FIG. 2A, the urinal fixture 101 includes a solar panel 260 for recharging the battery 255 (FIG. 7). Preferably, the solar panel 260 is embedded in the upper portion 160, such as in the access panel 250. In certain embodiments, the electronics corresponding to the solar panel 260 and the batter 255 are disposed within the upper portion 160 and accessible via the access panel 250 and securable via the locking mechanism [not shown].

In one embodiment, the flush mechanism 180 includes a level indicator providing an indication regarding whether the flush mechanism 180 is installed level. In one exemplary embodiment, the level indicator is a bubble-in-fluid device.

The foregoing description of embodiments of the present invention have been presented for purposes of illustration and description. It is not intended to be exhaustive or to limit the present invention to the precise form disclosed, and modifications and variations are possible in light of the above teachings or may be acquired from practice of the present invention. The embodiments were chosen and described to explain the principles of the present invention and its practical application to enable one skilled in the art to utilize the present invention in various embodiments and with various modifications as are suited to the particular use contemplated. The features of the embodiments described herein may be combined in all possible combinations of methods, apparatus, modules and systems.

What is claimed is:

1. A urinal comprising:

a urinal having a lower portion, a middle portion and an upper portion, the lower portion including a receptacle with a drain, the middle portion including a backstop and sidewalls for guiding liquid waste to the drain and connecting the lower portion to the upper portion, the upper portion containing a manifold and a flush mechanism;

the manifold positioned above the receptacle and comprising a chamber having a floor that includes a plurality of holes positioned adjacent the backstop, allowing fluid in the manifold to flow from the manifold down the backstop into the receptacle;

the flush mechanism being disposed above the manifold and including a flush reservoir pivotable about a pivot axis within a flush reservoir frame, the flush mechanism being in communication with a water inlet and a flush actuator;

the flush reservoir including a housing having an opening, the housing being nonsymmetrical about the pivot axis, the pivot axis being substantially parallel with the backstop, and having a fill position and a flush position, the flush reservoir configured to remain in the fill position when empty and movable to the flush position when a threshold volume of water is in the reservoir, the flush reservoir opening being in fluid communication with the water inlet when in the fill position and the flush reservoir opening being in fluid communication with the manifold when in the flush position;

the flush actuator for controlling the position of the flush reservoir, the flush actuator releasably retaining the flush reservoir in the fill position when the threshold volume of water is present in the flush reservoir; and the flush reservoir having a flow edge along the housing, the flow edge adjacent the opening and parallel with the pivot axis.

2. The urinal of claim 1, wherein the flush reservoir comprises a flow control bar, the flow control bar spanning the opening in the flush reservoir and spaced a distance from an edge of the flush reservoir over which fluid flows during a flush, the flow control bar and the flush reservoir housing defining a flow aperture through which water is able to flow from the flush reservoir to the manifold.

3. The urinal of claim 1, wherein the flush reservoir housing has a polyhedron shape defined by a two parallel sidewalls and a backside extending perpendicular therebetween, a bottom perpendicular to the sidewalls and opposite to and smaller than the opening, and a front side extending from the bottom nonparallel with the backside and bottom, the housing having a substantially trapezoidal cross-section, with a longer parallel side positioned above a shorter parallel side when the reservoir is in the fill position.

4. The urinal of claim 1, wherein the manifold chamber floor slopes downward toward the backstop and the plurality of holes are at located at substantially the lowest portion of the sloped floor.

5. The urinal of claim 1, further comprising a consumable dispenser in communication with the manifold.

6. The urinal of claim 5, wherein the consumable dispenser is further in communication with the flush reservoir.

7. The urinal of claim 1, wherein the threshold volume is 0.1 gallons.

8. The urinal of claim 1, wherein the first inlet is configured to provide potable water and further comprising a second inlet configured to provide grey water.

9. The urinal of claim 1, wherein a flush sensor is provided in communication with the flush reservoir and configured to provide information regarding the position of the flush reservoir.

10. The urinal of claim 9, further comprising a water flow sensor configured to provide information regarding the volume of water provided from the inlet since the last flush cycle occurred.

11. A flush mechanism for a urinal comprising:

a flush reservoir pivotally positioned within a flush reservoir frame, the flush reservoir being configured to receive water from a water inlet positioned above the flush reservoir and dispense water to an area below the flush reservoir;

the flush reservoir including a housing defining a volume and including at least one opening, the flush reservoir having a fill position wherein the opening is at the top of the flush reservoir and pivotable above a pivot axis from the fill position to a flush position wherein the opening is in a side of the flush reservoir;

the flush reservoir housing having a polyhedron shape with a substantially trapezoidal cross-section, with a longer parallel side positioned above a shorter parallel side when the flush reservoir is in the fill position;

the flush reservoir having a first center of gravity imposing a torque onto the flush reservoir such that the flush reservoir is most stable in the fill position, the flush reservoir having a second center of gravity when the flush reservoir is filled to a threshold volume, such that the flush reservoir is more stable in the flush position;

a flow control bar, the flow control bar spanning the opening in the flush reservoir and spaced a distance from an edge of the flush reservoir over which fluid flows during a flush, the flow control bar and the flush reservoir housing defining a flow aperture through which water is able to flow from the flush reservoir when in the flush position; and a flush actuator for controlling the position of the flush reservoir, the flush actuator releasably retaining the flush reservoir in the fill position when the threshold volume of water is present in the flush reservoir, wherein, the flush reservoir pivots from the fill position to the flush position when the flush reservoir is filled with the threshold volume and the water is dispensed from the flush reservoir until the center of gravity shifts to its original position providing a torque to the reservoir whereby the flush reservoir pivots back to the fill position.

12. The flush mechanism of claim 11, wherein the threshold volume is 0.1 gallons.

13. The flush mechanism of claim 11, wherein the flush mechanism includes a biasing mechanism operatively connected to the flush reservoir.

14. A flush control system comprising:

a flush reservoir pivotally positioned within a flush reservoir frame, the flush reservoir being configured to receive water from at least one water source positioned above the flush reservoir and to dispense water to an area below the flush reservoir;

the flush reservoir including a housing defining a volume and including at least one opening, the flush reservoir having a fill position wherein the opening is at the top of the flush reservoir and pivotable above a pivot axis from the fill position to a flush position wherein the opening is at the lowest portion of the reservoir;

the flush reservoir housing having a polyhedron shape with a substantially trapezoidal cross-section, with a longer parallel side positioned above a shorter parallel side when the flush reservoir is in the fill position;

the flush reservoir having a first center of gravity imposing a torque about the pivot axis such that flush reservoir is most stable in the fill position, the flush reservoir having a second center of gravity when the flush reservoir is filled to a threshold volume, such that the flush reservoir is more stable in the flush position; and a controller in communication with the at least one water source and a flush mechanism and configured to control the flow of water from the at least one water source and actuation of the control of water flow into the reservoir;

wherein, when the controller provides a signal to the at least one water source to fill the flush reservoir to the threshold volume the flush reservoir pivots from the fill position to the flush position and the water is dispensed from the flush reservoir until the center of gravity returns to its original position whereby the flush reservoir pivots back to the fill position.

15. The urinal of claim 1, wherein the manifold chamber is glazed.

16. The urinal of claim 2, wherein the flow aperture has a bow-tie shape such that less water will flow from a central portion than end portions of the flow aperture.

17. The urinal of claim 2, wherein the flow control bar extends over the opening providing the flow aperture for water egress from the flush reservoir and an inlet opening for water ingress into the flush reservoir.

18. The urinal of claim 2, wherein the flow aperture is substantially a width of the manifold.

19. The urinal of claim 18, wherein the manifold includes a manifold inlet aperture in communication with the flush reservoir and the manifold chamber, the manifold inlet aperture extending substantially the width of the manifold.

20. The urinal of claim 3, the housing further comprising a lip adjacent the flow aperture, the lip comprising a truncation of the front side, the lip extending the front to the flow edge perpendicular to the bottom.

21. A urinal comprising:

a urinal having a lower portion, a middle portion and an upper portion, the lower portion including a receptacle with a drain, the middle portion including a backstop and sidewalls for guiding liquid waste to the drain and connecting the lower portion to the upper portion, the upper portion containing a manifold and a flush mechanism;

the manifold positioned above the receptacle and comprising a chamber having a floor that includes a plurality of holes positioned adjacent the backstop, allowing fluid in the manifold to flow from the manifold down the backstop into the receptacle;

the flush mechanism being disposed above the manifold and including a flush reservoir pivotable about a pivot axis within a flush reservoir frame, the flush mechanism being in communication with a water inlet and a flush actuator;

the flush reservoir including a housing having an opening, the housing being nonsymmetrical about the pivot axis, the pivot axis being substantially parallel with the backstop, and having a fill position and a flush position, the flush reservoir configured to remain in the fill position when empty and movable to the flush position when a threshold volume of water is in the reservoir, the flush reservoir opening being in fluid communication with the water inlet when in the fill position and the flush reservoir opening being in fluid communication with the manifold when in the flush position;

the flush actuator for controlling the position of the flush reservoir, the flush actuator releasably retaining the flush reservoir in the fill position when the threshold volume of water is present in the flush reservoir;

the flush reservoir having a flow edge along the housing, the flow edge adjacent the opening and parallel with the pivot axis; and the housing having a plurality of drain holes near the flow edge.

* * * * *

UNITED STATES PATENT AND TRADEMARK OFFICE

CERTIFICATE OF CORRECTION

PATENT NO. : 8,201,282 B2
APPLICATION NO. : 12/422030
DATED : June 19, 2012
INVENTOR(S) : John R. Wilson It is certified that error appears in the above-identified patent and that said Letters Patent is hereby corrected as shown below:

Title Page, Item (73) Assignee should read as follows: Sloan Valve Company, Franklin Park, IL (US)

Signed and Sealed this
Twenty-second Day of April, 2014

Michelle K. Lee

Michelle K. Lee
*Deputy Director of the United States Patent and Trademark Office*